US006084618A

United States Patent [19]

Baker

[11] Patent Number: 6,084,618

[45] Date of Patent: Jul. 4, 2000

[54] FILTER FOR AN INKJET PRINTHEAD

[75] Inventor: Marc Frazier Baker, Georgetown, Ky.

[73] Assignee: Lexmark International, Inc., Lexington, Ky.

[21] Appl. No.: 09/359,470

[22] Filed: Jul. 22, 1999

[51] Int. Cl.[7] ..... B41J 2/175

[52] U.S. Cl. ..... 347/93; 347/86

[58] Field of Search ..... 347/84–86, 93, 347/67

[56] References Cited

U.S. PATENT DOCUMENTS

| | | | |
|---|---|---|---|
| 4,153,902 | 5/1979 | Kanayama . | |
| 4,864,329 | 9/1989 | Kneezel et al. . | |
| 5,124,717 | 6/1992 | Campanelli et al. | 347/93 |
| 5,141,596 | 8/1992 | Hawkins et al. . | |
| 5,204,690 | 4/1993 | Lorenze, Jr. et al. . | |
| 5,296,875 | 3/1994 | Suda | 347/93 |
| 5,317,339 | 5/1994 | Braun et al. | 347/93 |
| 5,481,289 | 1/1996 | Arashima et al. | 347/93 |
| 5,716,533 | 2/1998 | O'Neill et al. | 347/93 |
| 6,007,176 | 12/1999 | Askren et al. | 347/93 |

*Primary Examiner*—John Barlow
*Assistant Examiner*—Juanita Stephens
*Attorney, Agent, or Firm*—Michael T. Sanderson

[57] ABSTRACT

An ink jet printhead of an ink jet cartridge includes a filter plate that is downstream of the ink. Particularly, the filter plate is attached to the back of the heater chip of the printhead. The filter plate is in addition to a wire mesh filter that is disposed at the inlet of a plumbing standpipe that prevents particles which are shed from the ink reservoir from passing into the printhead chip assembly. The filter plate of the present invention prevents particles that originate in the plumbing standpipe channels below the wire mesh filter from clogging the bubble chambers of the heater chip of the printhead chip assembly. The filter plates are formed on a polymer sheet with a series of holes ablated using an eximer laser. The filter plates are bulk registered and laminated to the back of the heater chips wafer in sheet form during the circuit manufacturing process and then singulated when the wafer is diced into individual heater chips.

15 Claims, 2 Drawing Sheets

FILTER FOR AN INKJET PRINTHEAD

BACKGROUND OF THE INVENTION

1. Field of the Invention

The present invention relates to ink jet cartridges used in ink jet printers and, more particularly, to ink filters for printheads of ink jet cartridges.

2. Description of the Related Art

Ink jet printers utilize cartridges that hold ink and which selectively dispense or eject the ink during printing through a printhead. The cartridges are filled with ink after assembly. Once the cartridge is filled with ink, the cartridge is closed and ready for use.

Ink jet cartridges typically include a body or housing defining a chamber or cavity for the ink, a printhead in fluid communication with the ink chamber including a plurality of ink emitting nozzles, and circuitry coupled to the printhead and adapted to allow controlled ejection of ink from selected nozzles of the printhead during printing. The printhead includes heating elements associated with each nozzle and coupled to the circuitry that allow the ink to be selectively ejected from the nozzle by forming drops. The number and spacing of nozzles in the printhead determines the resolution of the printing. Generally, ink jet printheads now have a resolution of between 300 dpi (dots per inch) to 1200 dpi with the trend towards 1200 dpi and greater. The greater the number of dots per inch, the smaller the holes or nozzles.

Ink cartridges may contain one or several colors and/or strengths of ink. In the case of multiple inks within a single ink cartridge, the ink cartridge includes a separate ink reservoir and printhead for each ink. Each ink reservoir is in fluid communication with a particular printhead by plumbing channels generally known as standpipes.

Because the nozzles are so small, particle contamination in ink jet cartridges is a problem. Particles in the ink, or originating elsewhere, can clog the various nozzle inlets and other parts associated with the printhead. If the nozzles become clogged with particles, print quality is degraded.

It is known to provide a fine mesh stainless steel filter at the ink inlet of a standpipe in order to filter or prevent particles that originate in the ink reservoir from reaching the printhead and possibly clogging the nozzles, vias, and/or bubble chambers. However, these fine mesh standpipe inlet filters are not effective in screening particles that originate in the plumbing channels or below from reaching and clogging the printhead. Therefore, if particles are shed in the ink plumbing or downstream thereof during manufacture, shipping, or field use, the ink cartridge may suffer from print degradation. In general, particles originating downstream of the ink reservoir are not filtered from the ink.

What is needed is a filter for particles originating downstream of the ink reservoir, such as in the plumbing channels below the wire mesh filter in an ink jet cartridge.

SUMMARY OF THE INVENTION

The present invention is directed to an ink jet cartridge having an ink filter disposed downstream of the ink reservoir or plumbing channels of the ink cartridge.

In one form, the present invention is an ink jet cartridge having an ink filter downstream of the ink reservoir, the ink reservoir within a body of the ink cartridge and in fluid communication with a printhead. The ink reservoir is adapted to hold ink and is in fluid communication with a plumbing channel within the body via an inlet, the printhead in fluid communication with the outlet of the plumbing channel. The printhead includes a heater chip, a filter bonded to one side of the heater chip, and a nozzle plate bonded to another side of the heater chip.

Preferably, the filter is a polymer sheet having a plurality of holes therein with a thickness of between 1.5 to 2.5 mils. The holes are preferably approximately 8 microns in diameter.

In another form, the present invention is a printhead for an ink jet cartridge. The printhead includes a heater chip, a nozzle plate bonded onto one side of the heater chip, and a filter bonded onto another side of the heater chip. The printhead is mounted on the ink jet cartridge such that the ink enters the filter before flowing into the heater chip and nozzle plate.

In yet another form, the present invention is a method of manufacturing a manufacturing a printhead for an ink jet cartridge. First, a silicon wafer is provided. A plurality of via areas is produced on the silicon wafer with each via area having a plurality of vias therein. A polymer sheet is then provided in which are produced a plurality of filter areas with each filter area having a plurality of holes therein. The polymer sheet is then bonded to one side of the silicon wafer such that each filter area is registered with one of the via areas. The silicon wafer is then diced into individual heater chips with each chip having one of the filter areas and one of the via areas. Last a nozzle plate is bonded to the heater chip, the nozzle plate having a plurality of nozzles therein.

Preferably, the step of bonding the polymer sheet to the silicon wafer includes coating one side of the filter with an adhesive such as a phenolic coating. The filter areas are produced by abating a plurality of holes for each filter area with an eximer laser.

The present invention provides improved manufacturing yield because the printhead chip package is more tolerant to particle contamination. Additionally, the present invention provides reduced manufacturing capital costs since a smaller section of the manufacturing process will require cleanroom facilities.

BRIEF DESCRIPTION OF THE DRAWING

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates a preferred embodiment of the invention, in one form, and such exemplification is not to be construed as limiting the scope of the invention in any manner.

DETAILED DESCRIPTION OF THE INVENTION

Figure 1:
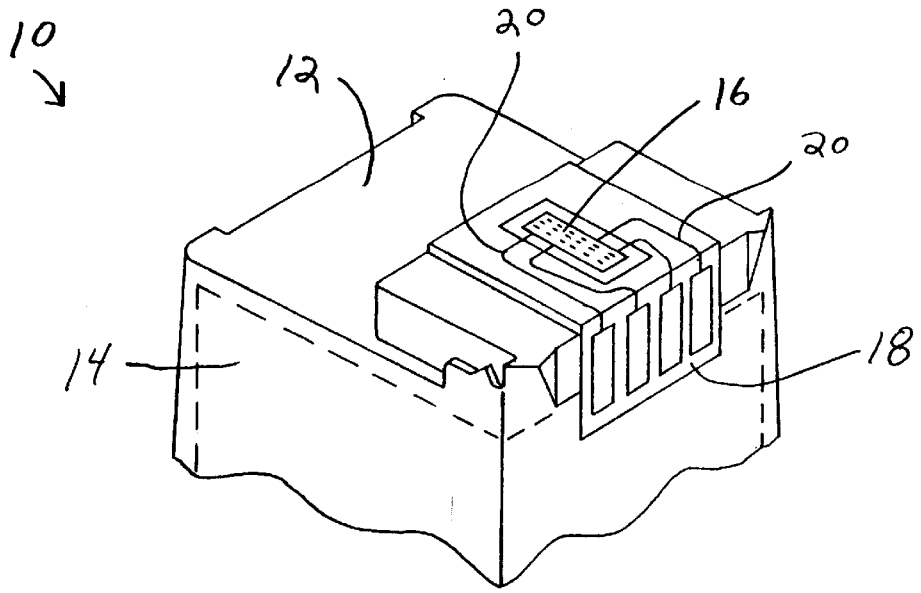
FIG. 1 is a partial top perspective view of an ink jet printer cartridge particularly showing its printhead.

Referring now to the drawings and, more particularly to FIG. 1, there is shown a partial view of ink jet cartridge 10.

Ink jet cartridge 10 includes body, housing, or shell 12 typically made from a suitable plastic of the like that encloses ink reservoir 14 adapted to retain a supply of ink suitable for ink jet printing as is known in the art. While body 12 is depicted with a single ink reservoir that holds a single ink, it should be understood that ink cartridge 10 may have several ink reservoirs, each reservoir holding a different color ink and/or a different strength of ink. Disposed on an end of body 12 is printhead 16 in fluid communication with ink reservoir 14 through which the ink is ejected. Ejection of ink from printhead 16 is controlled with electrical signals received from the ink jet printer (not shown) through TAB circuit 18 to leads 20 connecting TAB circuit 18 and printhead 16 as is known in the art. Ink jet cartridge 10 is depicted having only one printhead 16 since ink jet cartridge 10 holds a single ink in ink reservoir 14. Ink jet cartridge 10 would include a printhead for each ink, with each printhead coupled to a TAB circuit by leads 20 and controlled by electrical signals in the same manner as described above.

Figure 2:
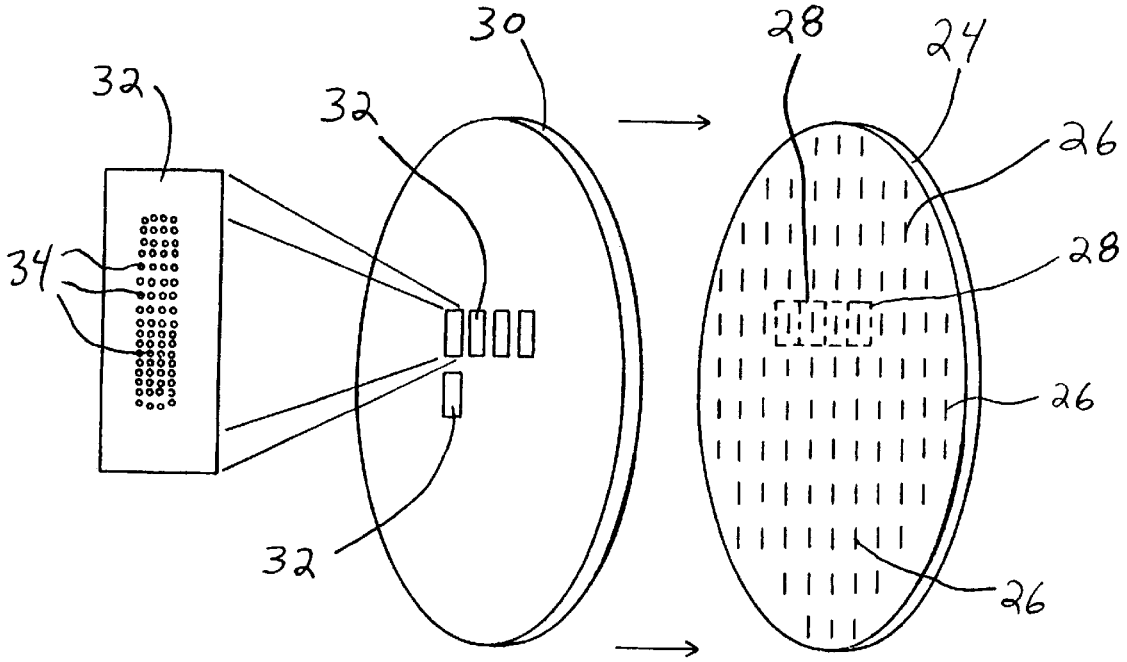
FIG. 2 is a perspective exploded view of a wafer substrate that will be cut into a plurality of heater chips and a filter sheet having a plurality of filter areas that overlays the wafer substrate in accordance with the present invention, a filter area of the filter sheet for one of the heater chips shown enlarged.

With reference now to FIG. 2, there is shown substrate or wafer 24 having a plurality of via areas 26. Each via area 26 includes a plurality of vias 50 (see FIG. 3) formed in a manner known in the art, but too small to be depicted in FIG. 2. Wafer 24 will be eventually diced or singulated into a plurality of heater chips 28 with each heater chip 28 encompassing a via area 26 as indicated by dashed rectangles. It should be understood that while there are only several heater chip areas represented by dashed lines, a heater chip is formed about each via area 26. Bonded to wafer 24 is filter sheet or plate 30 having a plurality of filter areas 32 of which only several filter areas are depicted by solid rectangles. The number of filter areas 32 generally correspond to the number of via areas 26. In one form, filter sheet 30 is a polymer sheet having a coating of adhesive on one side and, preferably a sheet of polyimide having a phenolic coating as a bonding adhesive on one side thereof that will contact wafer 24. A single filter area 32 is shown in enlarged detail. Filter area 32 includes a plurality of small bores or discrete holes 34 that are preferably made or ablated by an eximer laser. Filter sheet 30 is placed over and bonded to wafer 24 such that each filter area 32 covers a via area 28.

Filter sheet 30 is preferably 38–64 microns (1.5–2.5 mils) thick, while holes 34 are preferably around 8 microns in diameter. Of course, other hole sizes may be used. Generally filter sheet 30 is producable by a process similar to the process that produces nozzle plates which utilizes a plate laser machining process with a step and repeat table. The filter hole matrix is producable by a light mask in the laser beam path. Additional 3-Dimensional features beyond filtration, such as air bubble diverters, flow diverters, test ports, and vent ports, could also be added to filter sheet 30. Generally, filter sheet 30 is bulk registered and laminated to the back of wafer 24 during manufacturing, and is singulated when wafer 24 is diced into individual heater chips. The individual heater chips would then proceed through a circuit assembly process and be adhered to the ink body with die bond adhesive.

The filter plate sheet bonding process step could occur in parallel with the nozzle plate thermal compression bonding (TCB) process step. Dicing of wafer 24 to singulate the wafer into individual heater chips would be unchanged with the exception the cutting blade would cut wafer 24, nozzle plate 36 and filter sheet 30 bonded thereto.

Figure 3:
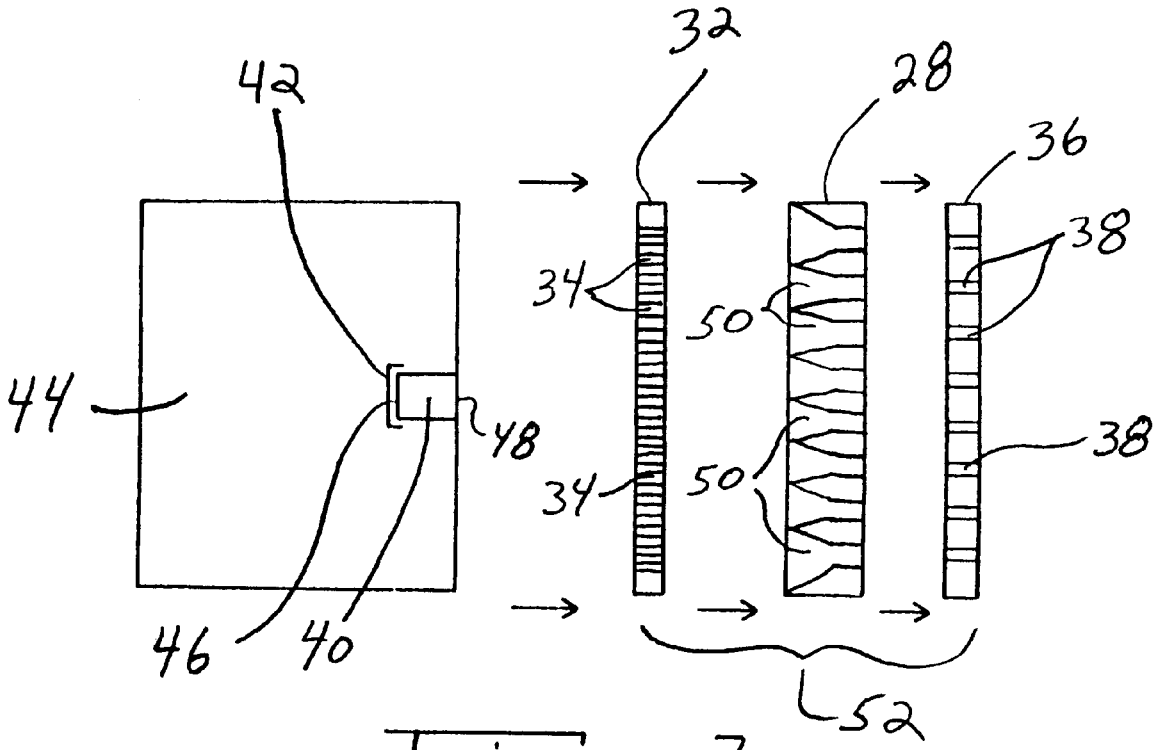
FIG. 3 is an exploded diagrammatic view of a printhead in accordance with an aspect of the present invention as it relates to the ink supply of the ink cartridge.

With reference now to FIG. 3, an exploded view of a single printhead 52 is depicted as it relates to the ink reservoir of an ink jet cartridge. Ink reservoir 44 is depicted having plumbing standpipe 40 that includes inlet 46 and outlet 48 which provides fluid communication between ink reservoir 44 and printhead 52. Disposed at inlet 46 is filter 42 that is preferably a wire mesh type filter that filters particles originating in ink reservoir 44. In accordance with an aspect of the present invention, printhead 52 includes filter 32 depicted in sectional in order to show holes 34, heater chip 28 also depicted in sectional in order to show vias 50, and nozzle plate 36 again depicted in sectional in order to show a plurality of nozzles 38. Ink from ink reservoir 44 flows through filter 42 into inlet 46 of standpipe 40 where any particles within ink reservoir 44 are prevented from flowing into standpipe 40 by filter 42. The ink exits standpipe 40 via outlet 48 and is distributed through holes 34 of filter 32. Particles originating after filter 42 will not flow through holes 34. The size of particles prevented from flowing through filter 32, of course, depends on the size of holes 34. The ink thereafter flows into vias 50 of heater chip 28. Upon bubble formation by heaters (not shown) in heater chip 28 as is known in the art, the ink is forced through nozzles 38 in nozzle plate 36. Filter 32 is thus downstream of ink reservoir 44 and will filter particles originating in standpipe 40 and thereafter.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ink jet cartridge comprising:

a body;

an ink reservoir within said body and adapted to hold ink;

a plumbing channel within said body and having an inlet in fluid communication with said ink reservoir and an outlet; and a printhead in fluid communication with said outlet of said plumbing channel, and including.

a heater chip having an inlet side, an outlet side, and a plurality of vias extending between said inlet side and said outlet side;

a filter bonded onto said inlet side of said heater chip and having a plurality of throughholes, each said throughhole having a first end and a second end, said first end being in direct fluid communication with said plumbing channel, said second end being in direct fluid communication with said vias in said heater chip; and a nozzle plate bonded to said outlet side of said heater chip.

2. The ink jet cartridge of claim 1, wherein said filter is bonded to a side of said heater chip adjacent said outlet of said plumbing channel, and said nozzle plate is bonded to another side of said heater chip opposite said filter.

3. The ink jet cartridge of claim 1, wherein said filter is a polymer sheet having a plurality of holes therein.

4. The ink jet cartridge of claim 3, wherein said polymer sheet comprises a polyimide sheet having a thickness of between 1.5 to 2.5 mils, and said holes are approximately 8 microns in diameter.

5. An ink jet cartridge comprising:

a body;

an ink reservoir within said body and adapted to hold ink;

a standpipe having an inlet in fluid communication with said ink reservoir and an outlet;

a first filter disposed at said inlet of said standpipe;

a printhead in fluid communication with said outlet of said standpipe, said printhead having a nozzle plate and a heater chip with an inlet side, an outlet side, and a plurality of vias extending between said inlet side and said outlet side; and a second filter disposed downstream of said outlet and adjacent to said inlet side of said heater chip.

6. The ink jet cartridge of claim 5, wherein said second filter is disposed between said outlet and said heater chip.

7. The ink jet cartridge of claim 5, wherein said second filter is a polymer sheet having a plurality of holes therein.

8. The ink jet cartridge of claim 7, wherein said polymer sheet comprises a polyimide sheet having a thickness of between 1.5 to 2.5 mils, and said holes are approximately 8 microns in diameter.

9. The ink jet cartridge of claim 5, wherein said second filter is bonded to said inlet side of said heater chip.

10. A printhead for an ink jet cartridge comprising:

a heater chip having an inlet side, an outlet side, and plurality of vias extending between said inlet side and said outlet side;

a nozzle plate bonded onto said outlet side of said heater chip; and a filter bonded onto said inlet side of said heater chip.

11. The printhead of claim 10, wherein said filter is a polymer sheet having a plurality of holes therein.

12. The printhead of claim 11, wherein said polymer sheet comprises a polyimide sheet having a thickness of between 1.5 to 2.5 mils.

13. The printhead of claim 11, wherein said holes have a diameter of approximately 8 microns.

14. The printhead of claim 10, wherein said filter is bonded to said inlet side of said heater chip by a phenolic coating on one side of said filter.

15. The ink jet cartridge of claim 1, wherein said filter defines a means for filtering ink immediately before the ink enters said vias in said heater chip.

* * * * *